US008418431B2

(12) United States Patent
Bertuzzi et al.

(10) Patent No.: US 8,418,431 B2
(45) Date of Patent: Apr. 16, 2013

(54) METHOD OF FOLDING A RECTANGULAR SHEET OF PACKING MATERIAL ABOUT A PARALLELEPIPIED-SHAPED ARTICLE TO FORM A TUBULAR WRAPPING WITH AN OPEN END

(75) Inventors: Ivanoe Bertuzzi, Casalecchio di Reno (IT); Roberto Polloni, Modigliana (IT); Stefano Negrini, Calderara di Reno (IT)

(73) Assignee: G.D Societa' per Azioni, Bologna (IT)

( * ) Notice: Subject to any disclaimer, the term of this patent is extended or adjusted under 35 U.S.C. 154(b) by 688 days.

(21) Appl. No.: 12/173,122

(22) Filed: Jul. 15, 2008

(65) Prior Publication Data

US 2009/0038269 A1 Feb. 12, 2009

(30) Foreign Application Priority Data

Jul. 18, 2007 (IT) ..... BO2007A0492

(51) Int. Cl.
*B65B 11/00* (2006.01)
*B65B 43/08* (2006.01)

(52) U.S. Cl.
USPC ..... 53/466

(58) Field of Classification Search ..... 53/466, 53/455, 456, 148, 228; 493/910, 911
See application file for complete search history.

(56) References Cited

U.S. PATENT DOCUMENTS 6,141,944 A * 11/2000 Spatafora ..... 53/466

FOREIGN PATENT DOCUMENTS

| | | | |
|---|---|---|---|
| EP | 2 330 223 | A1 | 6/2011 |
| JP | 51-61392 | | 5/1976 |
| JP | 57-28730 | A | 2/1982 |
| JP | 50-14348 | A | 1/1983 |
| JP | 61-96506 | A | 5/1986 |
| JP | 2001-504070 | A | 3/2001 |
| JP | 2002-362511 | A | 12/2002 |
| JP | 2004-67104 | A | 3/2004 |
| JP | 2006-206192 | | 8/2006 |
| JP | 2007-238170 | A | 9/2007 |

OTHER PUBLICATIONS

Office Action dated Nov. 27, 2012 for Application No. JP 2008-186245.
Espacenet English abstract of JP 4800442 B2.

* cited by examiner

*Primary Examiner* — M. Alexandra Elve
*Assistant Examiner* — John Paradiso
(74) *Attorney, Agent, or Firm* — Ladas & Parry LLP

(57) ABSTRACT

A method of folding a rectangular sheet of packing material about a parallelepiped-shaped article; the method providing for: bringing an end wall of the article into contact with the flat sheet of packing material, so that major transverse edges of the article are parallel to the short sides of the sheet of packing material, and minor transverse edges of the article are parallel to the long sides of the sheet of packing material; folding the sheet of packing material into a U about the major transverse edges of the end wall, so that the sheet of packing material completely covers both the major lateral walls of the article; and folding the sheet of packing material about longitudinal edges of a major lateral wall and onto minor lateral walls of the article, before folding the sheet of packing material about minor transverse edges of the end wall.

8 Claims, 7 Drawing Sheets

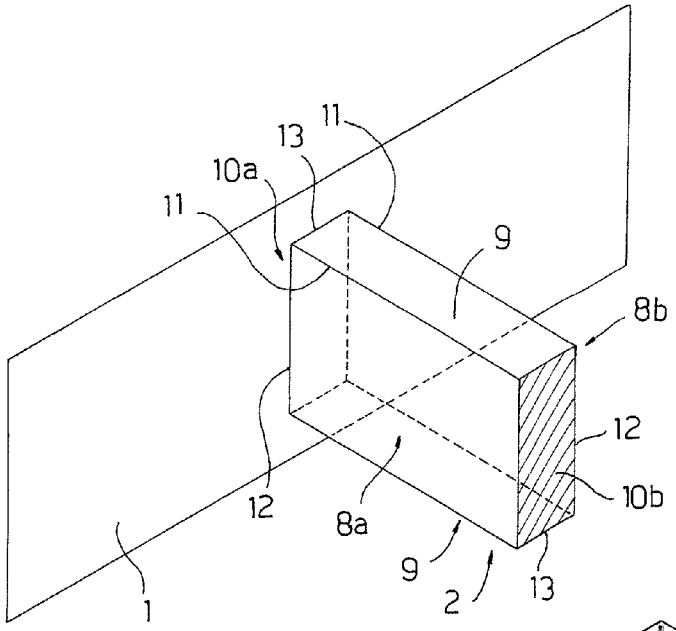
Fig.1
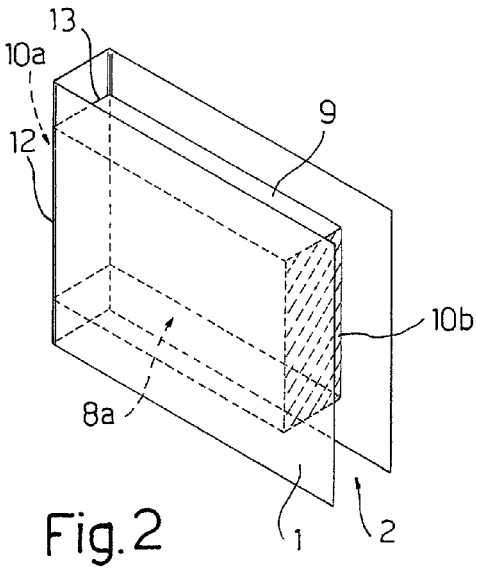
Fig.2
Fig.3
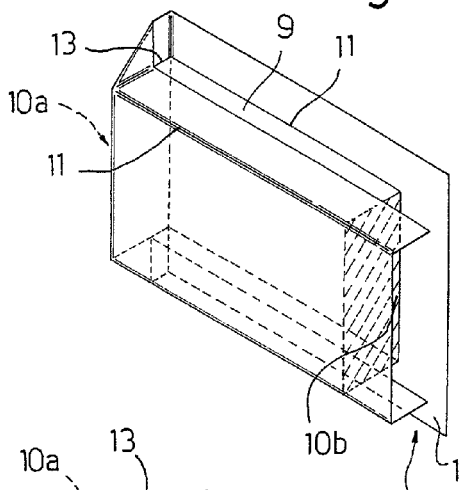
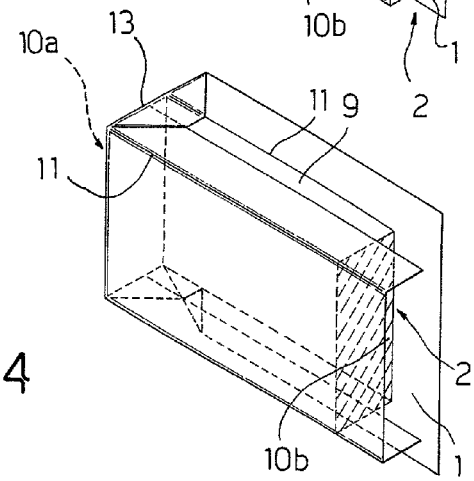
Fig.4

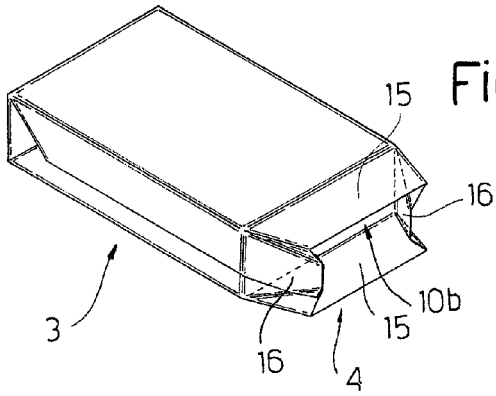
Fig.17
Fig.18
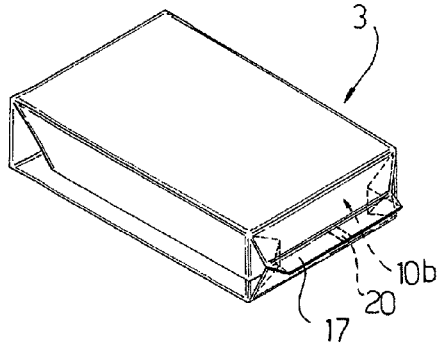
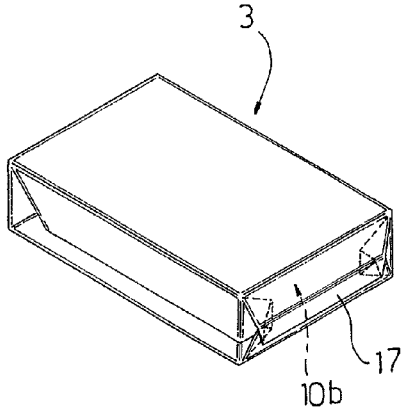
Fig.19
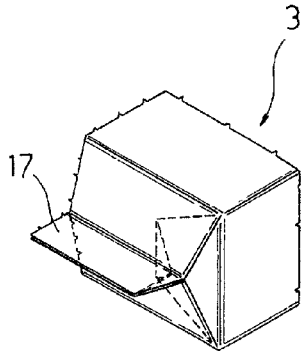
Fig.20

METHOD OF FOLDING A RECTANGULAR SHEET OF PACKING MATERIAL ABOUT A PARALLELEPIPIED-SHAPED ARTICLE TO FORM A TUBULAR WRAPPING WITH AN OPEN END

TECHNICAL FIELD

The present invention relates to a method of folding a rectangular sheet of packing material about a parallelepiped-shaped article to form a tubular wrapping with an open end.

The present invention may be used to particular advantage for folding a sheet of foil packing material about a group of cigarettes to produce a packet of cigarettes, to which the following description refers purely by way of example.

BACKGROUND ART

In a conventional packet of cigarettes, the group of cigarettes is wrapped internally in a rectangular sheet of foil inner packing material with no glue, and is packed externally in a rectangular sheet of outer packing material stabilized with glue.

Tobacco is highly sensitive to environment. That is, in contact with the atmosphere, its organic characteristics tend to vary alongside variations in humidity (by losing or absorbing too much moisture) or due to evaporation of the volatile substances with which the tobacco is impregnated (especially in the case of aromatic cigarettes treated with spices such as cloves). To preserve the tobacco, packets of cigarettes are therefore cellophane-wrapped, i.e. wrapped in a heat-sealed overwrapping of airtight plastic material. This, however, may not always be sufficient to fully preserve the organic characteristics of the tobacco in the packet, especially if the packet is consumed some time after manufacture. Moreover, when the packet is unsealed, the overwrapping is removed, thus exposing the tobacco to the atmosphere, and, if the cigarettes are not consumed soon after the packet is unsealed, the organic characteristics of the remaining cigarettes may deteriorate visibly.

In an attempt to eliminate this drawback, rigid packets of cigarettes have been proposed, in which the inner package is airtight, and comprises a sheet of airtight, heat-seal packing material having a cigarette extraction opening closed by a reusable cover flap. In other words, the cover flap has fastening means (e.g. a strip of non-dry re-stick adhesive) by which to repeatedly secure the cover flap in a closed position closing the cigarette extraction opening.

It has been observed that folding the sheet of inner packing material about the group of cigarettes may damage the tips of the cigarettes (i.e. the plain ends opposite the filter, where the tobacco is exposed), thus resulting in localized deformation and/or tobacco spill (i.e. tobacco fallout from the tips). This applies in particular to the corner cigarettes in the group, though damage is also evident in all the outermost cigarettes, i.e. located along the fold lines of the sheet of inner packing material. Folding a sheet of airtight inner packing material subjects the cigarettes to even more damage, by being thicker (and therefore stiffer) than conventional sheets of foil inner packing material. Moreover, at the cover flap (where the first end fold is made), the sheet of airtight inner packing material is even thicker and therefore locally extremely stiff.

To avoid damaging the cigarettes when folding a sheet of airtight inner packing material, it has been proposed to fold the sheet of airtight inner packing material first about a folding spindle to form a tubular wrapping with an open end; insert the group of cigarettes into the tubular wrapping through the open end; and complete folding of the sheet of airtight inner packing material by closing the open end onto the group of cigarettes. The method currently used to fold a sheet of airtight inner packing material, however, has the drawback of forming two longitudinal steps inside the tubular wrapping, at the closed end opposite the open end, and which impede insertion of the group of cigarettes into the tubular wrapping through the open end. In other words, as it slides inside the tubular wrapping, the group of cigarettes may strike and deform the steps, and so longitudinally reduce the space in which to accommodate the cigarettes. As a result, when inserting the group of cigarettes inside the tubular wrapping and closing the open end, the cigarettes are compressed longitudinally and therefore inevitably damaged.

Examples of folding a sheet of inner packing material about a group of cigarettes are described in Patent GB78507GA and Patent Application IT2006BO00347.

An airtight inner package made from a sheet of airtight, heat-seal packing material may sometimes "balloon" on account of surplus air trapped inside when forming the inner package. This "balloon" look is particularly undesirable, by being unsightly, and by increasing the size of the inner package and so making it difficult to fold the outer package around it.

DISCLOSURE OF THE INVENTION

It is an object of the present invention to provide a method of folding a rectangular sheet of packing material about a parallelepiped-shaped article to form a tubular wrapping with an open end, which method is designed to eliminate the aforementioned drawbacks, while at the same time being cheap and easy to implement.

According to the present invention, there is provided a method of folding a rectangular sheet of packing material about a parallelepiped-shaped article to form a tubular wrapping with an open end, as claimed in the attached Claims.

BRIEF DESCRIPTION OF THE DRAWINGS

A number of non-limiting embodiments of the present invention will be described by way of example with reference to the accompanying drawings, in which:

FIGS. 1-5 show schematic views in perspective of steps in the folding of a sheet of inner packing material to form a tubular wrapping with an open end, in accordance with the folding method of the present invention;

FIGS. 17-19 show schematic views in perspective of different folding steps to close the open end of the FIG. 5 tubular wrapping;

FIG. 20 shows a larger-scale view of a detail in FIG. 18.

PREFERRED EMBODIMENTS OF THE INVENTION

Figure 5:
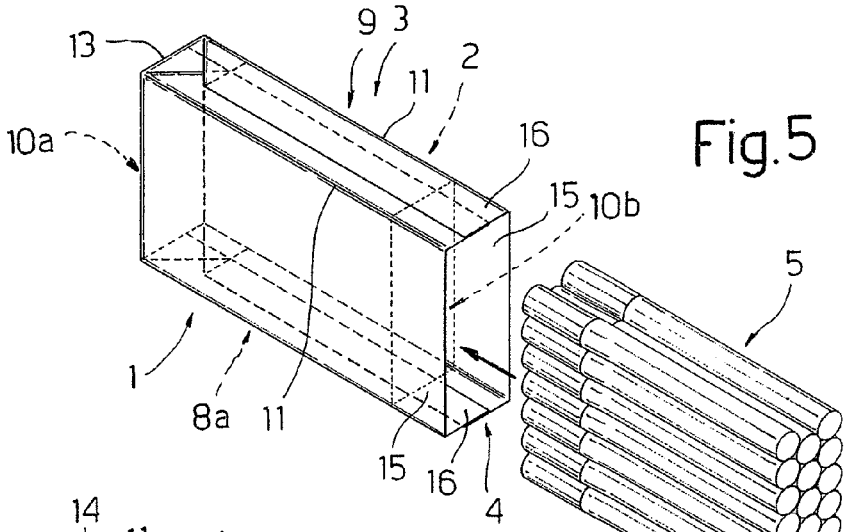

Number 1 in FIG. 1 indicates as a whole a sheet of packing material made of airtight laminated plastic material with an outer coating of heat-seal varnish. Sheet 1 of packing material is folded about a rectangular folding spindle 2 to form a tubular wrapping 3 (FIG. 5) with an open end 4 through which a group 5 of cigarettes (FIG. 5) is inserted into tubular wrapping 3. The folding of sheet 1 of packing material is then completed by closing open end 4 onto group 5 of cigarettes to form an inner package forming part of a packet of cigarettes (not shown); and the inner package is stabilized by heat sealing the superimposed portions of sheet 1 of packing material.

Figure 6:
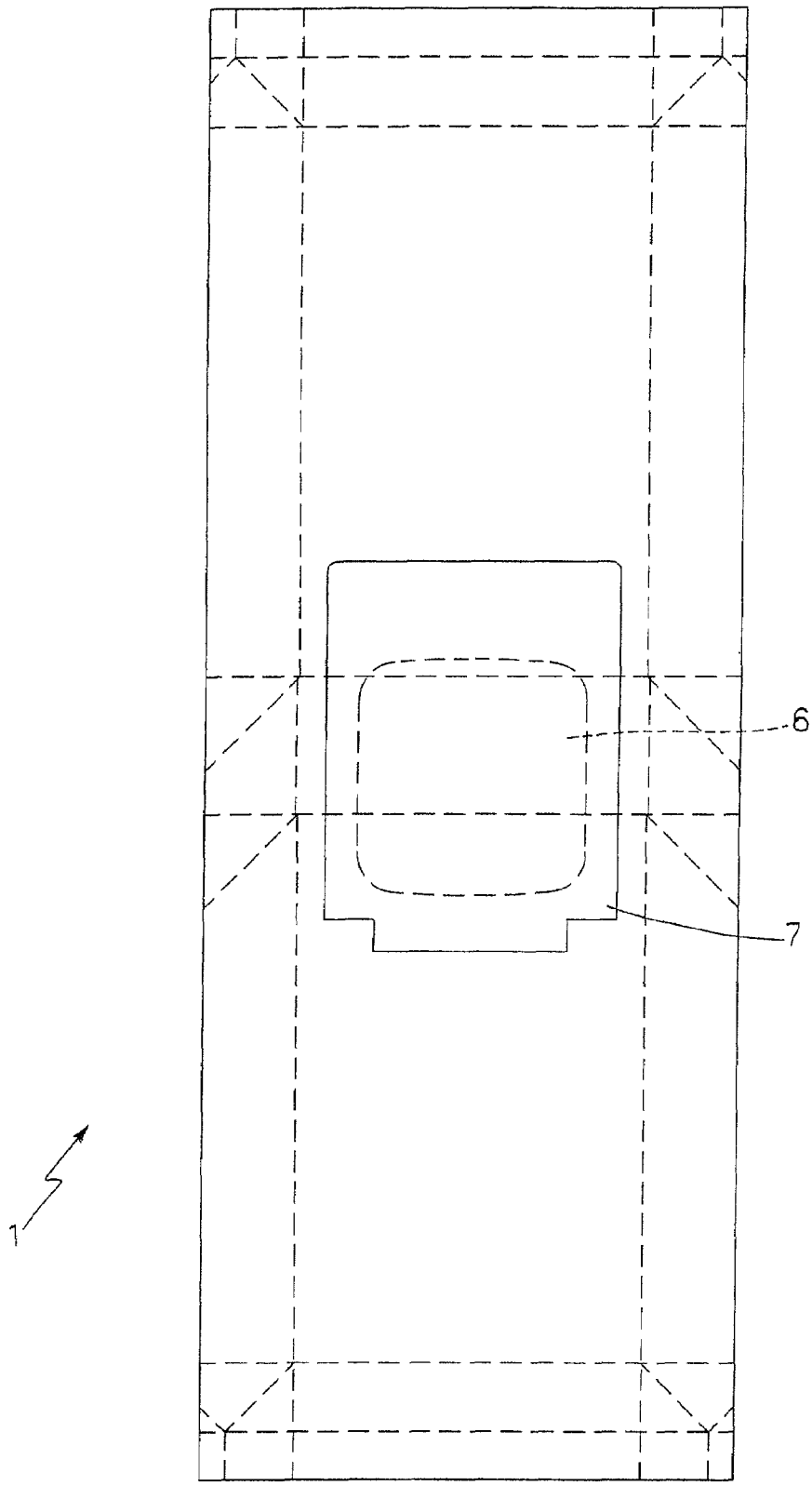
FIG. 6 shows a spread-out plan view, complete with fold lines, of the FIG. 1-5 sheet of inner packing material.
Figure 9:
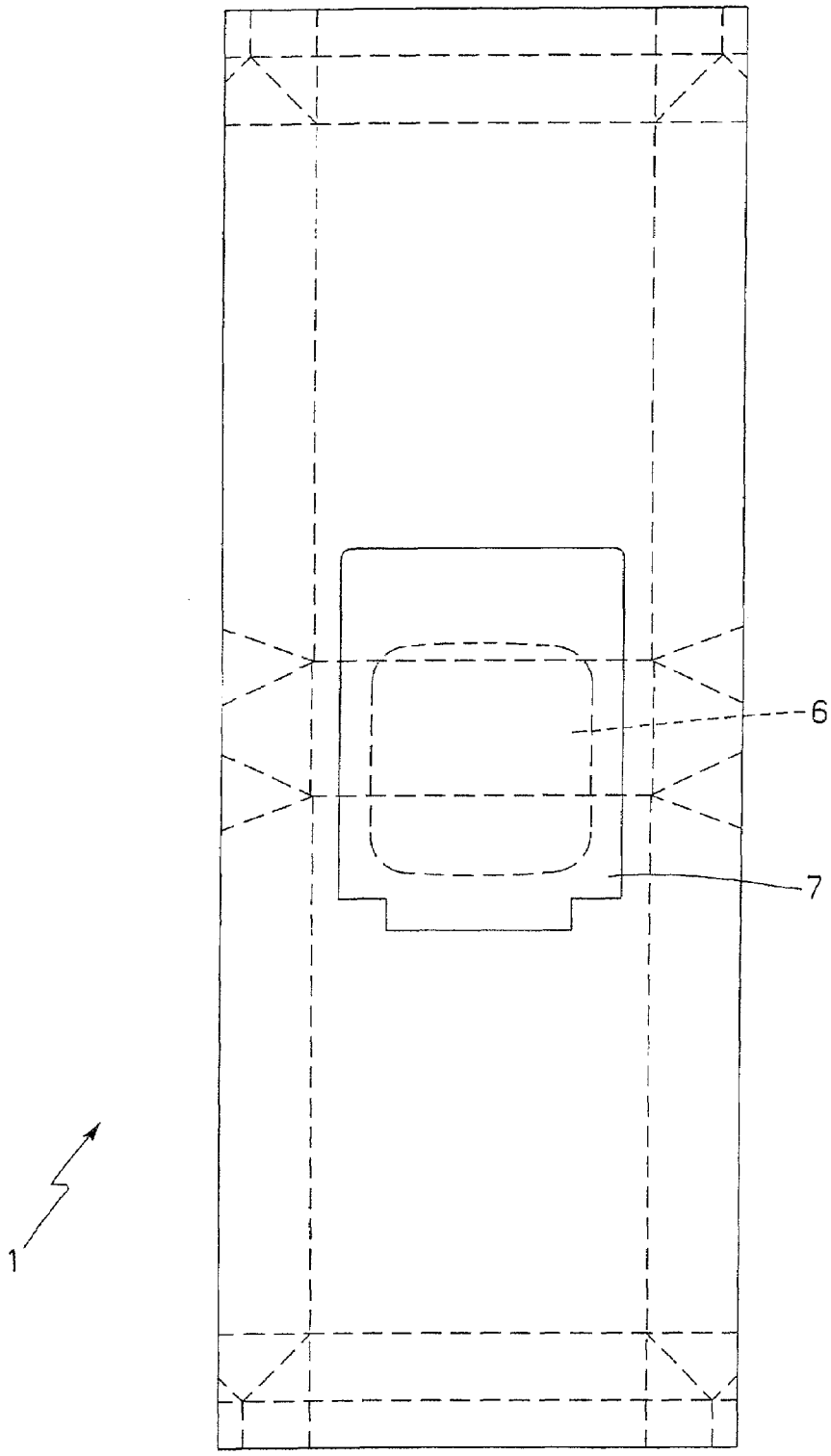
FIG. 9 shows a spread-out plan view, complete with fold lines, of the FIGS. 7 and 8 sheet of inner packing material.
Figure 11:
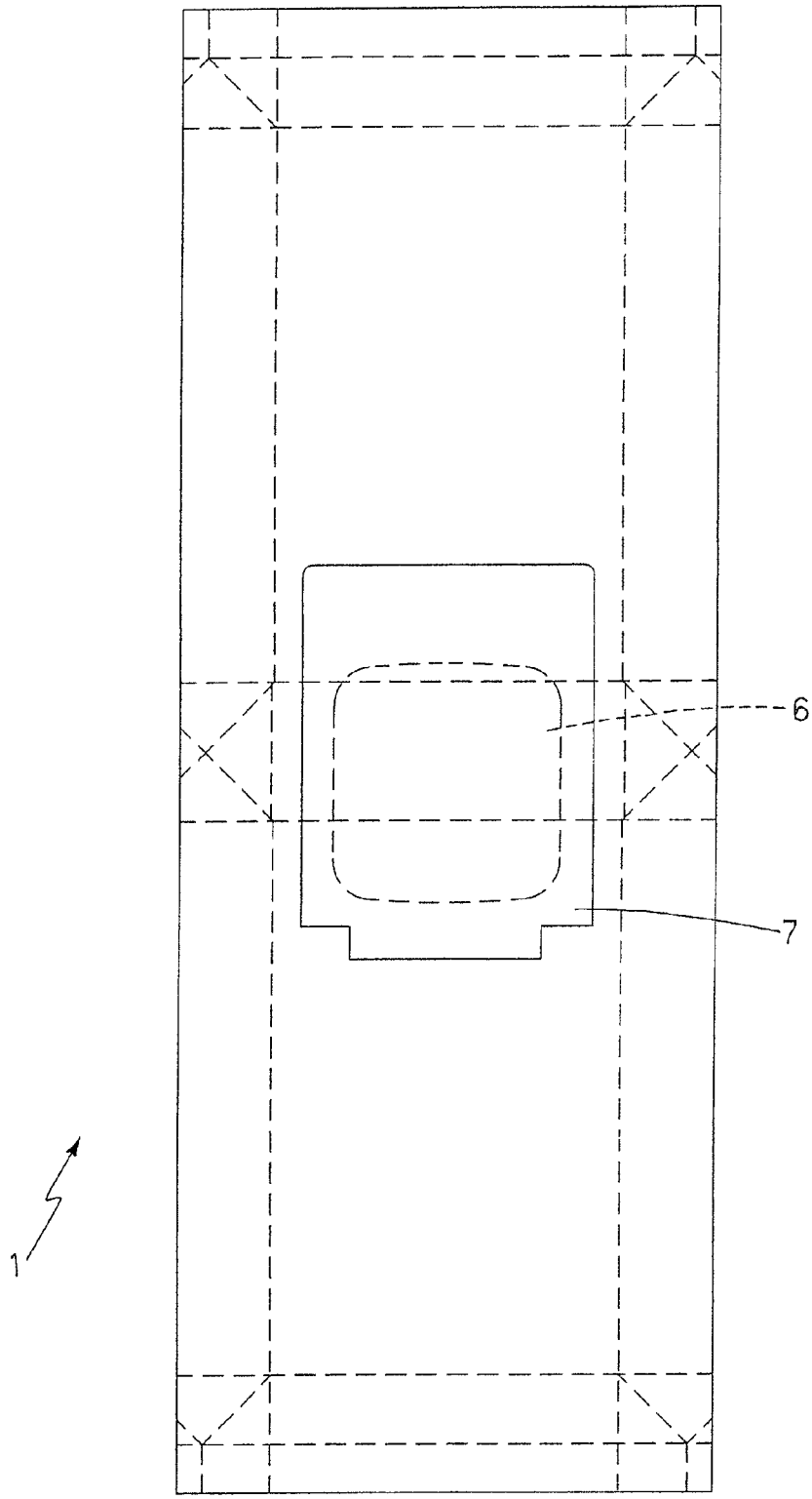
FIG. 11 shows a spread-out plan view, complete with fold lines, of the FIG. 10 sheet of inner packing material.

As shown in FIG. 6, sheet 1 of packing material is in the form of an elongated rectangle with two opposite parallel long sides, and two opposite parallel short sides, and has a cigarette extraction opening 6 closed by a reusable cover flap 7. Cover flap 7 is fixed to sheet 1 of packing material using non-dry, re-stick adhesive which is applied to the underside surface of cover flap 7 and extends about the whole of extraction opening 6, so cover flap 7 can be repeatedly detached partly from and fixed back onto sheet 1 of packing material. Before being folded, sheet 1 of packing material is cut to define extraction opening 6; and cover flap 7, gummed on the underside, is then applied to sheet 1 of packing material. That is, the underside surface of the cover flap is coated with re-stick adhesive which, inside extraction opening 6, glues the inner portion of sheet 1 of packing material permanently to cover flap 7, and, outside extraction opening 6, glues sheet 1 of packing material detachably to cover flap 7.

As shown in FIG. 1, folding spindle 2 is parallelepiped-shaped with a rectangular cross section, and has two opposite, parallel, rectangular major lateral walls 8 (only one shown in FIG. 1); two opposite, parallel, rectangular minor lateral walls 9 (only one shown in FIG. 1) smaller than major lateral walls 8; and two opposite, parallel, rectangular end walls 10 (only one shown in FIG. 1). Four longitudinal edges 11 (only three shown in FIG. 1) are defined between the two major lateral walls 8 and the two minor lateral walls 9; four major transverse edges 12 (only three shown in FIG. 1) are defined between the two major lateral walls 8 and the two end walls 10; and four minor transverse edges 13 (only three shown in FIG. 1) are defined between the two minor lateral walls 9 and the two end walls 10.

In a preferred embodiment, folding spindle 2 is tubular, and end walls 10 of folding spindle 2 are open to permit insertion of group 5 of cigarettes through folding spindle 2.

The way in which sheet 1 of packing material is folded about folding spindle 2 to form the FIG. 5 tubular wrapping 3 will now be described with reference to FIGS. 1-5.

As shown in FIG. 1, a first end wall 10*a* of folding spindle 2 is first brought into contact with the flat sheet 1 of packing material, so that major transverse edges 12 of folding spindle 2 are parallel to the short sides of sheet 1 of packing material, and minor transverse edges 13 of folding spindle 2 are parallel to the long sides of sheet 1 of packing material. First end wall 10*a* of folding spindle 2 is preferably positioned symmetrically in the centre of sheet 1 of packing material with respect to both the long sides and short sides of sheet 1 of packing material.

As shown in FIG. 2, sheet 1 of packing material is then folded into a U about major transverse edges 12 of first end wall 10*a* so as to completely cover both major lateral walls 8.

At this point, sheet 1 of packing material is folded about longitudinal edges 11 of a first major lateral wall 8*a* onto minor lateral walls 9 (FIG. 3), and is then folded about minor transverse edges 13 of first end wall 10*a* onto minor lateral walls 9 (FIG. 4). Finally, as shown in FIG. 5, sheet 1 of packing material is folded about longitudinal edges 11 of a second major lateral wall 8*b* onto minor lateral walls 9 to complete tubular wrapping 3, with an open end 4 at a second end wall 10*b*.

Figure 7:
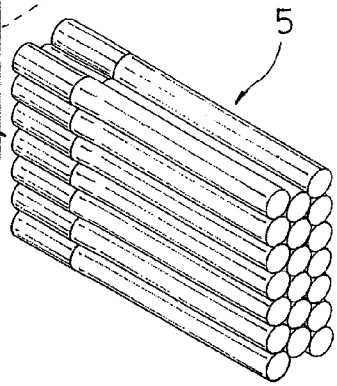
FIGS. 7 and 8 show schematic views in perspective of a variation of the folding steps in FIGS. 4 and 5.
Figure 7:
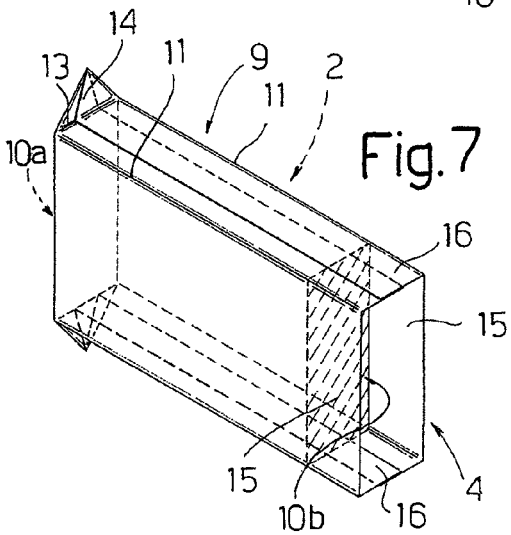
Figure 8:
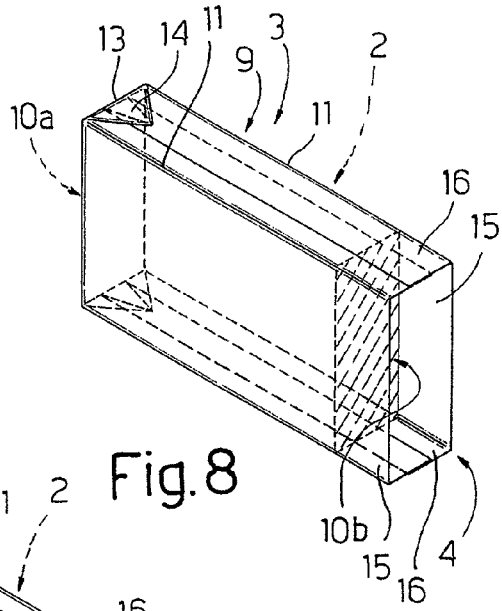
Figure 10:
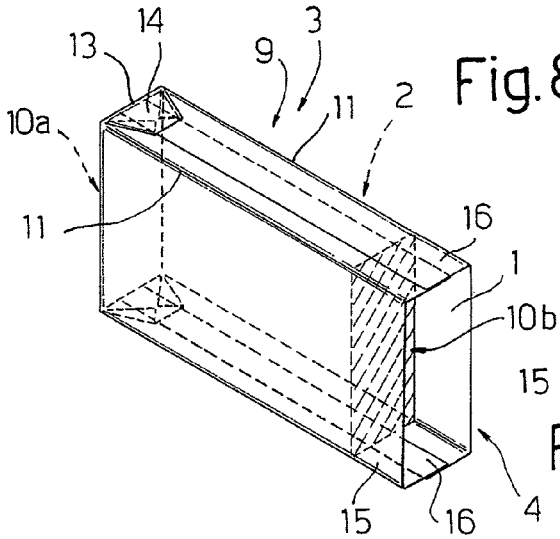
FIG. 10 shows a schematic view in perspective of a variation of the FIG. 8 folding step.

In the FIGS. 7 and 8 variation, after being folded about longitudinal edges 11 of first major lateral wall 8*a* onto minor lateral walls 9 (FIG. 3), sheet 1 of packing material is folded about longitudinal edges 11 of second major lateral wall 8*b* onto minor lateral walls 9 (FIG. 7). Finally, as shown in FIG. 8, sheet 1 of packing material is folded about minor transverse edges 13 of first end wall 10*a* onto minor lateral walls 9 to complete tubular wrapping 3, with an open end 4 at second end wall 10*b*. When the last fold of sheet 1 of packing material is made about minor transverse edges 13 of first end wall 10*a* onto minor lateral walls 9, two flaps 14 are formed on the outside and resting on minor lateral walls 9, close to first end wall 10*a*. Depending on the geometry of the longitudinal folds (i.e. about longitudinal edges 11), flaps 14 may be either triangular (as shown in FIG. 8) or trapezoidal (as shown in FIG. 10).

Once formed in one of the ways described above, tubular wrapping 3 is stabilized by two longitudinal heat seals to heat seal the superimposed portions of sheet 1 of packing material on minor lateral walls 9.

The tubular wrapping 3 in the FIG. 1-5 embodiment has two small steps inside, which are very unlikely to obstruct insertion of group 5 of cigarettes into tubular wrapping 3 through open end 4; whereas the tubular wrapping 3 in the FIGS. 1-3, 7 and 8 embodiment has no steps at all inside, which might obstruct insertion of group 5 of cigarettes into tubular wrapping 3 through open end 4.

In the embodiments shown in the drawings, sheet 1 of packing material is first folded about folding spindle 2 to form tubular wrapping 3 with open end 4; and only afterwards is group 5 of cigarettes inserted inside tubular wrapping 3 through open end 4. In a different embodiment, sheet 1 of packing material may be folded directly about group 5 of cigarettes in the ways described above.

Figure 12:
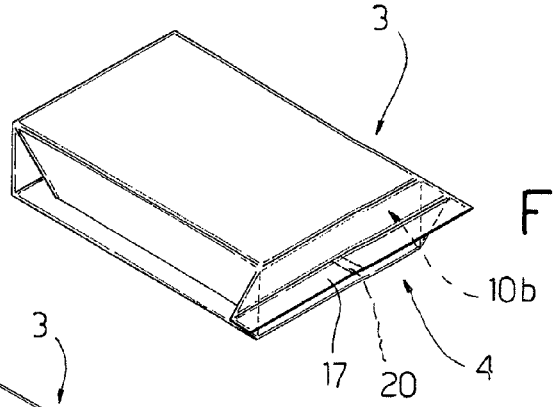
FIGS. 12-14 show schematic views in perspective of folding steps to close the open end of the FIG. 5 tubular wrapping.
Figure 13:
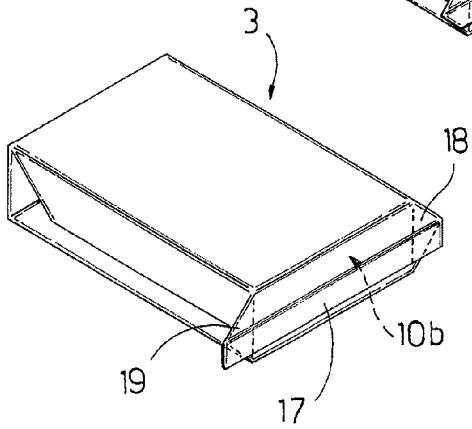
Figure 14:
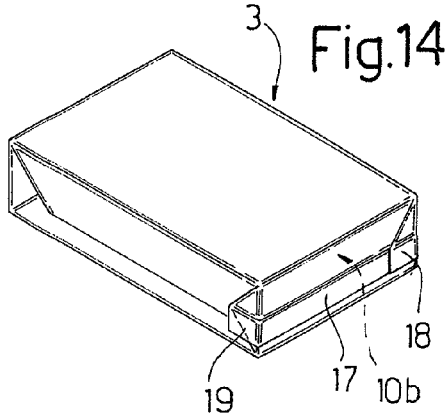
Figure 15:
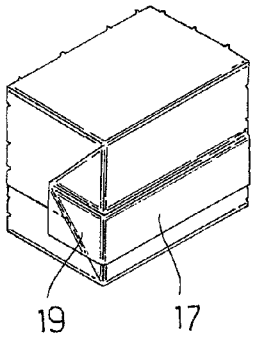
FIGS. 15 and 16 show two larger-scale views of two details in FIG. 14.
Figure 16:
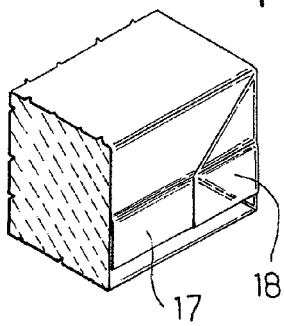

FIGS. 12-14 show one way of folding sheet 1 of packing material at open end 4 of tubular wrapping 3, to close tubular wrapping 3 and form the inner package containing group 5 of cigarettes. Open end 4 of tubular wrapping 3 comprises two major flaps 15 at major transverse edges 12; and two minor flaps 16 at minor transverse edges 13.

Since folding spindle 2 and group 5 of cigarettes are substantially the same shape and size, group 5 of cigarettes will be described, for the sake of simplicity, using the same reference numbers as for the corresponding parts of folding spindle 2. Group 5 of cigarettes is parallelepiped-shaped with a rectangular cross section, and has two opposite, parallel, rectangular major lateral walls 8 (only one shown in FIG. 5) defined by cylindrical lateral walls of the cigarettes; two opposite, parallel, rectangular minor lateral walls 9 (only one shown in FIG. 5) defined by cylindrical lateral walls of the cigarettes and smaller than major lateral walls 8; and two opposite, parallel, rectangular end walls 10 (only one shown in FIG. 5) defined by flat ends of the cigarettes. Four longitudinal edges 11 (only three shown in FIG. 5) are defined between the two major lateral walls 8 and the two minor lateral walls 9; four major transverse edges 12 (only three shown in FIG. 5) are defined between the two major lateral walls 8 and the two end walls 10; and four minor transverse edges 13 (only three shown in FIG. 5) are defined between the two minor lateral walls 9 and the two end walls 10.

First, the two major flaps 15 of open end 4 of tubular wrapping 3 are folded together about major transverse edges 12 onto end wall 10*b*, so as to overlap centrally and define a rectangular central flap 17 perpendicular to end wall 10*b* (FIG. 12), and which is stabilized by heat sealing the superimposed portions of the two major flaps 15. In a preferred embodiment, the two major flaps 15 are folded together and simultaneously heat sealed by a gripper-type heat-sealing device with two heated jaws, of the type described in Patent Application EP1686060A1, which is incorporated herein by way of reference.

Next, central flap 17 is folded 90° onto end wall 10*b* (FIG. 13) to form two trapezoidal lateral flaps 18 and 19, which are then folded 90° onto end wall 10*b* and a minor lateral wall 9 respectively (FIG. 14). Finally, flaps 18 and 19 are stabilized by heat sealing them to end wall 10*b* and minor lateral wall 9 respectively. In a preferred embodiment, flaps 18 and 19 are folded and simultaneously heat sealed by a heated folding device.

In a different embodiment not shown, lateral flaps 18 and 19 are both folded and heat sealed onto end wall 10*b* or onto respective minor lateral walls 9.

FIGS. 17 and 18 show an alternative way of folding sheet 1 of packing material at open end 4 of tubular wrapping 3, to close tubular wrapping 3 and form the inner package containing group 5 of cigarettes.

As shown in FIG. 17, the two minor flaps 16 of open end 4 of tubular wrapping 3 are first folded partly about minor transverse edges 13 towards end wall 10*b*. The two major flaps 15 are then folded together about major transverse edges 12 onto end wall 10*b*, so as to overlap centrally and define rectangular central flap 17 perpendicular to end wall 10*b* (FIG. 18), and which is stabilized by heat sealing the superimposed portions of the two major flaps 15. In a preferred embodiment, the two major flaps 15 are folded together and simultaneously heat sealed by a gripper-type heat-sealing device with two heated jaws.

Finally, central flap 17 is folded 90° onto end wall 10*b* (FIG. 19), and is then stabilized by heat sealing it to end wall 10*b*. In a preferred embodiment, central flap 17 is folded and simultaneously heat sealed to end wall 10*b* by a heated folding device.

With respect to the FIG. 17-19 folding method, the FIG. 12-14 folding method has the advantage of central flap 17 being of constant thickness, whereas, in the FIG. 17-19 folding method, central flap 17 varies in thickness (is thicker at the sides and thinner in the middle). The FIG. 12-14 folding method therefore makes it easier to heat seal central flap 17.

In a preferred embodiment, when heat sealing the two major flaps 15 to stabilize central flap 17, at least one portion of flap 17 is left unsealed to define at least one through exhaust channel 20 (FIGS. 12 and 18) connecting the inside of tubular wrapping 3 to the outside, and which provides, during subsequent folding operations, for letting out any surplus air trapped inside tubular wrapping 3, and so preventing "ballooning" of tubular wrapping 3. Once folding and heat sealing of sheet 1 of packing material are completed, exhaust channel 20 is closed by means of a further heat seal formed by applying heat and pressure to central flap 17, at exhaust channel 20.

The invention claimed is:

1. A method of folding a sheet of packing material about an article to form a tubular wrapping with an open end wherein the sheet of packing material is in the form of an elongated rectangle with two opposite parallel long sides and two opposite parallel short sides;

the article is substantially parallelepiped-shaped with a rectangular cross section, and comprises first and second major lateral walls, first and second minor lateral walls that are smaller than the major lateral walls, and first and second end walls that are smaller than the minor lateral walls and the major lateral walls;

four longitudinal edges are defined between the two major lateral walls and the two minor lateral walls, four major transverse edges are defined between the two major lateral walls and the two end walls, and four minor transverse edges are defined between the two minor lateral walls and the two end walls;

the method comprising the steps of:

bringing the first end wall of the parallelepiped-shaped article into contact with the flat sheet of packing material, so that the major transverse edges of the article are parallel to the short sides of the sheet of packing material, and the minor transverse edges of the article are parallel to the long sides of the sheet of packing material;

folding the sheet of packing material into a U about the major transverse edges of the first end wall, so that the sheet of packing material completely covers both the major lateral walls; and folding the sheet of packing material about the longitudinal edges of a first major lateral wall onto the minor lateral walls, before folding the sheet of packing material about the minor transverse edges of the first end wall.

2. A method as claimed in claim 1, and comprising the further steps of:

folding the sheet of packing material about the minor transverse edges of the first end wall onto the minor lateral walls; and then folding the sheet of packing material about the longitudinal edges of the second major lateral wall onto the minor lateral walls to complete the tubular wrapping with the open end at a second end wall.

3. A method as claimed in claim 1, and comprising the further steps of:

folding the sheet of packing material about the longitudinal edges of the second major lateral wall onto the minor lateral walls; and then folding the sheet of packing material about the minor transverse edges of the first end wall onto the minor lateral walls to complete the tubular wrapping with the open end at the second end wall.

4. A method as claimed in claim 3, wherein two triangular flaps are formed on the outside, and rest on the minor lateral walls, close to the first end wall.

5. A method as claimed in claim 3, wherein two trapezoidal flaps are formed on the outside, and rest on the minor lateral walls, close to the first end wall.

6. A method as claimed in claim 1, wherein the first end wall of the article is positioned symmetrically in the center of the sheet of packing material with respect to both the long sides of the sheet of packing material and the short sides of the sheet of packing material.

7. A method as claimed in claim 1, wherein the article is defined by a group of cigarettes.

8. A method as claimed in claim 1, wherein the article is a rectangular tube having a hollow interior and open end walls to permit insertion of a group of cigarettes there through, the method further comprising inserting the group of cigarettes into the tubular wrapping through the open end of the tubular wrapping and one of the open end walls of the rectangular tube.

* * * * *